US009777734B2

(12) United States Patent
Lu et al.

(10) Patent No.: US 9,777,734 B2
(45) Date of Patent: Oct. 3, 2017

(54) THIN FAN

(71) Applicant: DELTA ELECTRONICS, INC., Taoyuan Hsien (TW)

(72) Inventors: Chao-Wen Lu, Taoyuan Hsien (TW); Chun-Chih Wang, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 472 days.

(21) Appl. No.: 14/283,040

(22) Filed: May 20, 2014

(65) Prior Publication Data

US 2015/0110648 A1 Apr. 23, 2015

(30) Foreign Application Priority Data

Oct. 23, 2013 (TW) ..... 102138187 A

(51) Int. Cl.
*F04D 17/16* (2006.01)
*F04D 25/06* (2006.01)

(52) U.S. Cl.
CPC ..... *F04D 25/062* (2013.01); *F04D 17/16* (2013.01)

(58) Field of Classification Search
CPC ..... F04D 25/062; F04D 17/16; F04D 25/0613–25/0646
See application file for complete search history.

(56) References Cited

U.S. PATENT DOCUMENTS 5,434,729 A * 7/1995 Katakura ..... G11B 19/2009 360/99.08
5,829,889 A * 11/1998 Kerr ..... F16C 25/08 384/446
5,996,685 A * 12/1999 Alizadeh ..... F04D 29/326 123/41.49
6,084,328 A * 7/2000 Yamashita ..... F04D 29/063 310/63
6,208,050 B1 * 3/2001 Fujii ..... F16C 25/08 310/51
6,420,809 B1 * 7/2002 Obara ..... F16C 17/02 310/90

(Continued)

FOREIGN PATENT DOCUMENTS

CN 101127462 A 2/2008
CN 203230598 U 10/2013

(Continued)

*Primary Examiner* — Peter J Bertheaud
*Assistant Examiner* — Dnyanesh Kasture
(74) *Attorney, Agent, or Firm* — Muncy, Geissler, Olds & Lowe, P.C.

(57) ABSTRACT

A thin type fan includes an impeller and a motor. The impeller includes a hub and a blade structure disposed around the hub. The motor includes a stator structure, a magnetic assembly, a bearing structure and a rotational shaft. The motor drives the impeller to rotate. The magnetic assembly is disposed within the hub and around the stator structure. The magnetic assembly includes a magnet and a magnetically permeable shell. The bearing structure includes a bearing seat and a single ball bearing. The single ball bearing is disposed in the bearing seat and forms an accommodating space, and the rotational shaft is disposed in the accommodating space.

16 Claims, 3 Drawing Sheets

(56) References Cited

U.S. PATENT DOCUMENTS

| | | | | |
|---|---|---|---|---|
| 6,873,069 | B1 * | 3/2005 | Odagiri | H01L 23/467 165/122 |
| 6,960,023 | B2 * | 11/2005 | Hsu | F16C 17/10 384/125 |
| 2005/0058544 | A1 * | 3/2005 | Omi | F04D 29/059 415/220 |
| 2006/0065986 | A1 * | 3/2006 | Morie | A61K 8/02 261/26 |
| 2011/0280753 | A1 * | 11/2011 | Chen | F04D 29/668 417/423.12 |
| 2012/0057966 | A1 | 3/2012 | Chen et al. | |
| 2013/0004348 | A1 * | 1/2013 | Sugiyama | F16C 33/745 417/423.7 |

FOREIGN PATENT DOCUMENTS

| | | | |
|---|---|---|---|
| TW | 383818 | U | 3/2000 |
| TW | 200427934 | A | 12/2004 |
| TW | 201211394 | A1 | 3/2012 |

* cited by examiner

THIN FAN

CROSS REFERENCE TO RELATED APPLICATIONS

This Non-provisional application claims priority under 35 U.S.C. §119(a) on Patent Application No(s). 102138187 filed in Taiwan, Republic of China on Oct. 23, 2013, the entire contents of which are hereby incorporated by reference.

BACKGROUND OF THE INVENTION

Field of Invention

The invention relates to a fan structure and, in particular, to a thin type fan.

Related Art

Various electronic apparatuses are made with a thinner and thinner shape, so that the fan is developed toward a thinning tendency for the cooperation with the electronic apparatus.

FIG. 1 is a sectional diagram of a conventional fan. As shown in FIG. 1, the conventional fan 1 includes a bushing 10, a stator 11, a rotor 12 having blades 16, bearings 13*a* and 13*b*, springs 14 and a fastening ring 15. For fixing the rotor 12, two bearings 13*a* and 13*b* are disposed on two sides of the bushing 10 and the fastening ring 15 is used. Moreover, at least two springs 14 are disposed at the top end of the bushing 10 to provide a sufficient preload. However, under the condition of maintaining these basic components of the fan 1, the height H of the fan 1 is uneasily to be reduced to below 5 mm.

Therefore, it is an important subject to provide a thin type fan that includes less components and has a thinner structure.

SUMMARY OF THE INVENTION

In view of the foregoing subject, an objective of the invention is to provide a thin type fan.

To achieve the above objective, a thin type fan according to the invention includes an impeller, a motor and at least a magnetic element.

The impeller includes a hub and a blade structure disposed around the hub. The hub includes a rotational shaft portion, which is a bushing.

The motor includes a stator structure, a magnetic assembly, a bearing structure and a rotational shaft. The motor drives the impeller to rotate. The magnetic assembly is disposed within the hub and around the stator structure. The magnetic assembly includes a magnet and a magnetically permeable shell. The bearing structure includes a bearing seat and a single ball bearing. The single ball bearing is disposed in the bearing seat and forms an accommodating space, and the rotational shaft is disposed in the accommodating space.

In one embodiment, the thin type fan further includes at least a magnetic element disposed on one side of the bearing seat to attract the bearing structure.

In one embodiment, the magnetic element attracts an inner ring of the single ball bearing of the bearing structure.

In one embodiment, the magnetic element includes a first magnetic element disposed corresponding to the bearing structure. The thin type fan further includes a bottom plate. The motor and the impeller are sequentially disposed on the bottom plate, the bottom plate has an opening disposed corresponding to the bearing structure, and the first magnetic element is disposed to the opening.

In one embodiment, the first magnetic element is an annular structure or a circular structure.

In one embodiment, the thin type fan further includes a bottom plate. The motor and the impeller are sequentially disposed on the bottom plate, the bottom plate has at least an accommodating portion, and the magnetic element further includes a second magnetic element disposed in the accommodating portion.

In one embodiment, the accommodating portion is disposed corresponding to the magnetic assembly.

In one embodiment, the ratio of the height of the impeller to the that of the thin type fan is at least greater than 0.5.

In one embodiment, the whole height of the thin type fan is equal to or less than 5 mm. The total weight of the impeller, the magnetic assembly and the rotational shaft is equal to or less than 5 grams.

In one embodiment, the magnetic element attracts the rotational shaft.

In one embodiment, the rotational shaft is partially disposed in the accommodating space. The magnetic element is disposed around the rotational shaft.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 2:
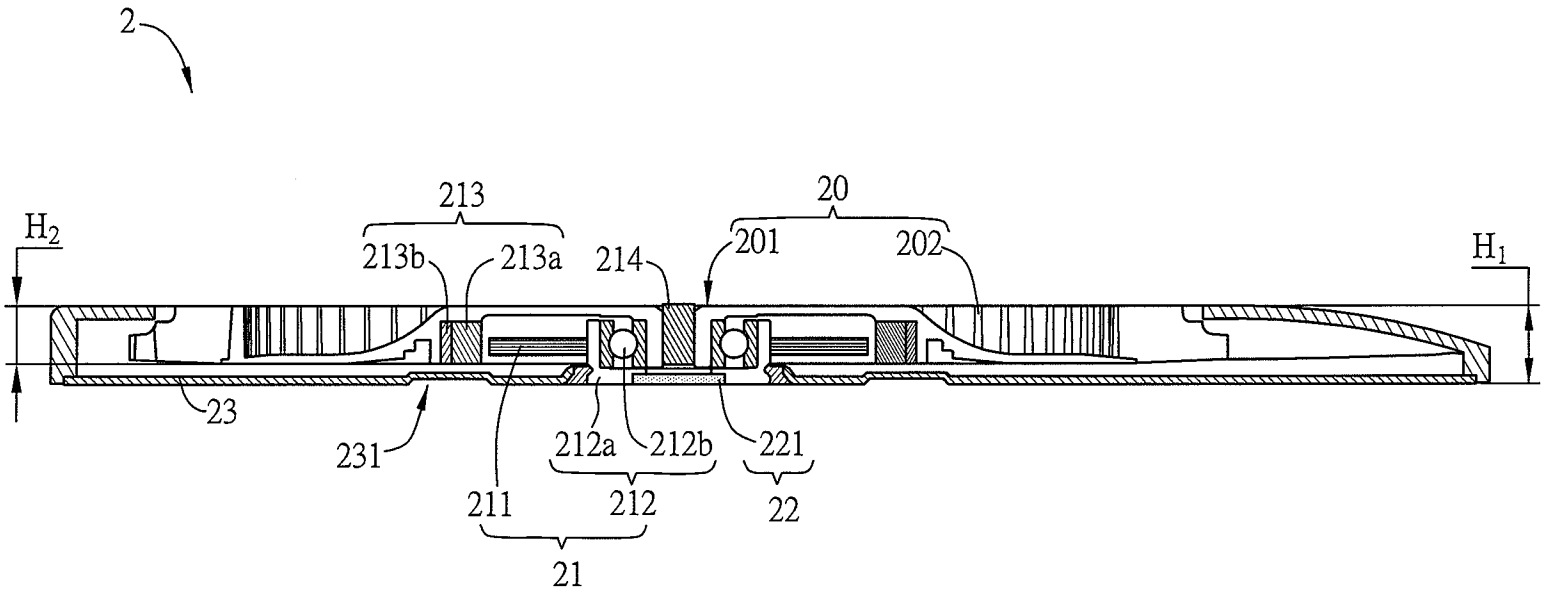
FIG. 2 is a schematic sectional diagram of a thin type fan according to the first embodiment of the invention.

FIG. 2 is a schematic sectional diagram of a thin type fan according to the first embodiment of the invention.

As shown in FIG. 2, the thin type fan 2 includes an impeller 20 and a motor 21. The thin type fan 2 further includes at least a magnetic element 22. In this embodiment, the magnetic element 22 at least includes a first magnetic element 221.

The impeller 20 includes a hub 201 and a blade structure 202. The blade structure 202 is disposed around the hub 201. The hub 201 has a through hole, and the structure of the through hole can be a hollow cylindrical portion. In this embodiment, the blade structure 202 and the hub 201 can be integrated into a single piece but this invention is not limited thereto.

The motor 21 includes a stator structure 211, a bearing structure 212, a magnetic assembly 213 and a rotational shaft 214. The motor 21 drives the impeller 20 to rotate. The magnetic assembly 213 is disposed within the hub 201 and around the stator structure 211.

The magnetic assembly 213 includes a magnet 213*a* and a magnetically permeable shell 213*b*, and the magnet 213*a* is disposed adjacent to the stator structure 211. The bearing structure 213 includes a bearing seat 212*a* and a single ball bearing 212*b*. The single ball bearing 212*b* is disposed in the bearing seat 212*a* and forms an accommodating space. The rotational shaft 214 is disposed in the accommodating space and is tightly fit with the hub 201. The single ball bearing 212*b* of this embodiment can provide a supporting force for the hub 201.

The said accommodating space is formed by the bearing seat 212*a* and the single ball bearing 212*b*, for the rotational shaft 214 to be disposed therein.

Figure 1:
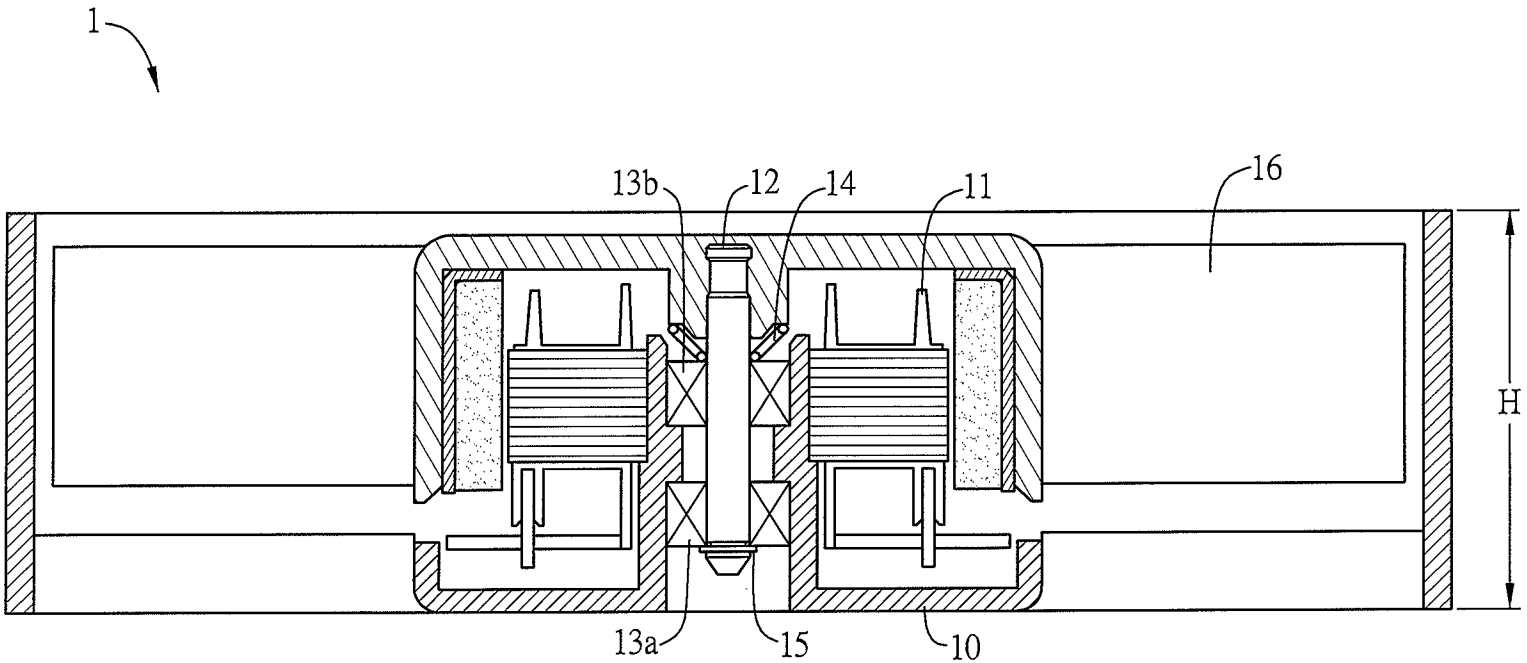
FIG.1 (Prior Art)
FIG. 1 is a sectional diagram of a conventional fan.

When the magnetic element 22 is disposed on one side of the bearing seat 212*a*, the magnetic element 22 can attract the bearing structure 212 to provide a preload for the bearing structure 212. The said preload can be provided by adjusting the magnetic force of the magnetic element 22. By such kind of disposition, the components of the conventional fan can be decreased. For example, the spring 14 of the conventional fan in FIG. 1 can be removed, and therefore the whole components of the motor are decreased and the thinner structure can be thus achieved.

In FIG. 2, the first magnetic element 221 is disposed on one side of the bearing seat 212*a* so as to attract the bearing structure 212. In detail, the first magnetic element 221 can attract the inner ring of the single ball bearing 212*b* of the bearing structure 212. The inner ring of the single ball bearing 212*b* is at least partially made by a magnetically permeable material, which can be, for example but is not limited to, silicon steel, amorphous alloy, ferromagnetic or ferrite.

The thin fan type 2 further includes a bottom plate 23, and the motor 21 and the impeller 20 are sequentially disposed on the bottom plate 23. The bottom plate 23 has an opening (not shown) disposed corresponding to the bearing structure 212, and the bearing seat 212*a* and the first magnetic element 221 can be disposed to the opening.

According to different requirements, the first magnetic element 221 can be adjusted to have an annular shape or a circular shape. In other embodiments, the first magnetic element 221 also can be composed of a plurality of magnetic elements, such as two semicircular structures, but the invention is not limited thereto.

The bottom plate 23 of the embodiment can further include at least an accommodating portion 231, which can be disposed at a place below the impeller 20 and around the hub that is regarded as the center. Besides, the accommodating portion 231 is favorably disposed closer to the magnetic assembly 213. For example, the accommodating portion 231 is a convex indentation, and the convex side faces the magnetic assembly 213.

In this embodiment, the accommodating portion 231 is also made by a magnetically permeable material so as to attract the magnet 213*a* of the magnetic assembly 213, so that the impeller 20 is attracted and a preload is thus indirectly provided for the bearing structure 212.

The rotational shaft 214 of the thin type fan 2 can be disposed through the through hole (e.g. a hollow cylindrical portion) of the hub 201. When the rotational shaft 214 is disposed through the through hole, it will make the hub 201 slightly expand in a radial direction, and that means the through hole is slightly flared. Therefore, the rotational shaft 214 will contact the hub 201 more tightly and the mechanical strength of the thin type fan 2 can be thus enhanced.

The rotational shaft 214 also can be made by a magnetically permeable material, so the first magnetic element 221 can attract the rotational shaft 214 besides the bearing structure 212.

In FIG. 2, the ratio of the height $H_2$ of the impeller 20 to the height $H_1$ of the thin type fan 2 is at least greater than 0.5. Besides, the total height of the then type fan 2 is equal to or less than 5 mm, and the total weight of the impeller 20, the magnetic assembly 213 and the rotational shaft 214 is equal to or less than 5 grams.

In one embodiment, the above-mentioned limitation (≤5 gm) of the total weight is not only effective for the combination of the impeller 20, the magnetic assembly 213 and the rotational shaft 214, and in other embodiments, the limitation of the total weight may include the whole rotational structure that the bearing structure 212 can bear.

Figure 3:
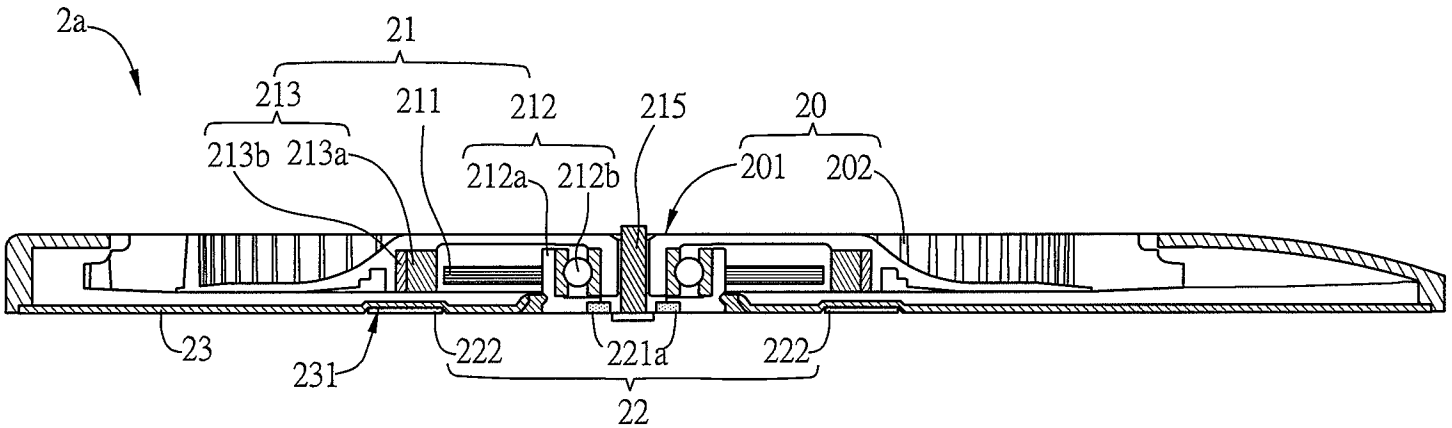
FIG. 3 is a schematic sectional diagram of a thin type fan according to the second embodiment of the invention.

FIG. 3 is a schematic sectional diagram of a thin type fan according to second embodiment of the invention.

Different from the first embodiment, at least a magnetic element 22 of this embodiment further includes a second magnetic element 222. The second magnetic element 222 is disposed in the accommodating portion 231 of the bottom plate 23.

As shown in FIG. 3, the magnetic element 22 of the thin type fan 2*a* further includes a second magnetic element 222, which is disposed in the accommodating portion 231 so as to attract the magnetic assembly 213. By such kind of disposition, the impeller 20 can be attracted and the function of the fastening ring 15 (in FIG. 1) of the conventional motor can be achieved so that the fastening ring 15 can be removed. Besides, this kind of disposition also can indirectly provide a preload for the bearing structure 212.

In this embodiment, the second magnetic element 222 also can be composed of a plurality of magnetic elements, such as two semicircular structures, but the invention is not limited thereto.

Different from the first embodiment, the rotational shaft 215 of the thin type fan 2*a* of this embodiment can be partially disposed to the bottom plate 23 or other components, and at least partially disposed in the accommodating space. In other words, the rotational shaft 215 of this embodiment is at least partially protruded from the hub 201.

Because the rotational shaft 215 is at least partially protruded from the hub 201, the thin type fan 2*a* can be prevented from the collision by the external force, which may deform the exterior housing or damage the interior components. In detail, when the thin type fan 2*a* is disposed in an electronic apparatus and the electronic apparatus is pressed or struck, the upper housing of the thin type fan 2*a* may be concaved. So, if the rotational shaft 215 is not protruded from the hub 201, the upper housing will directly press the thin type fan 2*a*. However, in the case of the rotational shaft 215 protruded from the hub 201, the deformation of the upper housing will be blocked or diminished by the rotational shaft 215, and therefore the thin type fan 2*a* can avoid being damaged.

For fitting the above-mentioned rotational shaft 215, the first magnetic element 221*a* of this embodiment is favorably an annular structure or composed of at least two magnets. The first magnetic element 221*a* can be disposed around the rotational shaft 215.

The components of the second embodiment with the same denotations as the first embodiment can be comprehended by referring to the first embodiment, and therefore they are not described here for conciseness.

In summary, by disposing the single ball bearing and reducing the quantity of the components of the thin type fan of the invention, the whole height of the thin type fan can be reduced to below 5 mm, and therefore the thin structure can be achieved.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A thin fan, comprising:

an impeller including a hub and a blade structure disposed around the hub;

a motor including a stator structure, a magnetic assembly, a bearing structure and a rotational shaft, wherein the motor rotates the impeller, the magnetic assembly is disposed within the hub and around the stator structure, the magnetic assembly includes a magnet and a magnetically permeable shell, the bearing structure includes a bearing seat and a single ball bearing, the single ball bearing is disposed in the bearing seat and forms an accommodating space, and the rotational shaft is disposed in the accommodating space; and a bottom plate, wherein the motor and the impeller are concentrically disposed on the bottom plate, the bottom plate has at least one accommodating portion, the at least one accommodating portion is a convex indentation made by a magnetically permeable material, and the convex indentation has a convex side, wherein the convex indentation is disposed under the magnetic assembly with the convex side directly toward the magnetic assembly, and the magnetic assembly is aligned with the convex indentation along an axial direction of the magnet.

2. The thin fan as recited in claim 1, further comprising at least one magnetic element disposed on one side of the bearing seat to attract an inner ring of the single ball bearing.

3. The thin fan as recited in claim 2, wherein the at least one magnetic element attracts an inner ring of the single ball bearing of the bearing structure.

4. The thin fan as recited in claim 2, wherein the at least one magnetic element includes a first magnetic element disposed corresponding to the bearing structure.

5. The thin fan as recited in claim 4, wherein the bottom plate has an opening disposed corresponding to the bearing structure, and the first magnetic element is disposed to the opening.

6. The thin fan as recited in claim 4, wherein the first magnetic element is an annular structure or the first magnetic element has a circular boundary.

7. The thin fan as recited in claim 2, wherein the at least one magnetic element further includes a second magnetic element disposed in the accommodating portion.

8. The thin fan as recited in claim 7, wherein the accommodating portion is disposed corresponding to the magnetic assembly.

9. The thin fan as recited in claim 4, wherein the at least one magnetic element further includes a second magnetic element disposed in the accommodating portion.

10. The thin fan as recited in claim 9, wherein the accommodating portion is disposed corresponding to the magnetic assembly.

11. The thin fan as recited in claim 1, wherein a ratio of the height of the impeller to the height of the thin fan is greater than or equal to 0.5.

12. The thin fan as recited in claim 1, wherein a maximum height of the thin fan is equal to or less than 5 mm.

13. The thin fan as recited in claim 1, wherein the total weight of the impeller, the magnetic assembly and the rotational shaft is equal to or less than 5 grams.

14. The thin fan as recited in claim 2, wherein the at least one magnetic element attracts the rotational shaft.

15. The thin fan as recited in claim 14, wherein the at least one magnetic element is disposed around the rotational shaft.

16. The thin fan as recited in claim 2, wherein the rotational shaft is partially disposed in the accommodating space.

* * * * *